US006605168B1

(12) United States Patent
Bleibler et al.

(10) Patent No.: US 6,605,168 B1
(45) Date of Patent: Aug. 12, 2003

(54) METHOD FOR FASTENING A FLAT STRIP LAMELLA TO THE SURFACE OF A BUILDING COMPONENT

(75) Inventors: Alexander Bleibler, Winterthur (CH); Ernesto Schümperli, Wollerau (CH); Werner Steiner, Winterthur (CH)

(73) Assignee: Sika Schweiz AG (CH)

( * ) Notice: Subject to any disclaimer, the term of this patent is extended or adjusted under 35 U.S.C. 154(b) by 0 days.

(21) Appl. No.: 09/485,003

(22) PCT Filed: Jan. 31, 2000

(86) PCT No.: PCT/EP98/04384

§ 371 (c)(1),
(2), (4) Date: Feb. 25, 2000

(87) PCT Pub. No.: WO99/06652

PCT Pub. Date: Feb. 11, 1999

(30) Foreign Application Priority Data

Jul. 31, 1997 (DE) ..... 197 33 066

(51) Int. Cl.[7] ..... E04C 5/00

(52) U.S. Cl. ..... 156/71; 156/64; 156/273.9; 156/275.5; 156/275.7

(58) Field of Search ..... 156/64, 71, 94, 156/273.9, 275.5, 275.7, 307.1, 307.7, 185, 187, 272.2, 274.2; 52/600, 422, 730.2

(56) References Cited

U.S. PATENT DOCUMENTS

| | | | | |
|---|---|---|---|---|
| 3,239,403 A | * | 3/1966 | Williams et al. | 156/273.9 |
| 4,385,957 A | * | 5/1983 | Wackerle et al. | 156/273.9 |
| 4,560,428 A | | 12/1985 | Sherrick et al. | |
| 4,684,789 A | * | 8/1987 | Eggleston | 156/272.2 |
| 5,648,137 A | * | 7/1997 | Blackmore | 428/102 |
| 5,937,606 A | * | 8/1999 | Meier et al. | 52/600 |
| 6,389,775 B1 | * | 5/2002 | Steiner et al. | 52/600 |

FOREIGN PATENT DOCUMENTS

| | | | | |
|---|---|---|---|---|
| DE | 137 01 | | 8/1979 | |
| DE | 31 25 393 A1 | | 1/1983 | |
| DE | 33 31 199 A1 | | 3/1985 | |
| DE | 35 21 708 A1 | | 12/1986 | |
| DE | 38 18 066 A1 | | 7/1989 | |
| DE | 41 26 188 C2 | | 5/1993 | |
| DE | 42 03 505 A1 | | 8/1993 | |
| DE | 43 35 696 A1 | | 4/1995 | |
| DE | 195 38 468 A1 | | 4/1997 | |
| DE | 19753318 A1 | * | 6/1999 | ..... E04C/5/00 |
| FR | 2 502 140 | | 9/1982 | |
| FR | 2 594 871 | | 8/1987 | |
| WO | WO 9605386 A1 | | 2/1996 | |

OTHER PUBLICATIONS

CFK–Laschenverstarkung von Betonbauteilen—technisch hochwertig und wirtschaftlich; Prof. dipl. Bauing; das bauzentrum 1/96, 99.

* cited by examiner

*Primary Examiner*—Michael W. Ball
*Assistant Examiner*—John T. Haran
(74) *Attorney, Agent, or Firm*—Pendorf & Cutliff

(57) ABSTRACT

A method for fastening a flat strip lamella (10) to the surface of a building component (12). According to the inventive method, the face (14) of the flat strip lamella (10) is pressed against the surface of the building using an adhesive coating (16) consisting of a reaction resin applied in a paste-like consistency (16) and hardened to form an adhesive joint. The flat strip lamella (10) comprises a plurality of carbon fibers which are embedded in a binder matrix (28) and placed parallel to each other in a longitudinal direction. In order to increase the speed at which the adhesive coating hardens, the invention provides that an electrical current flows through least one part of the carbon fibers (26), heating the flat strip lamella (10) which in turn heats the adhesive coating (16).

9 Claims, 1 Drawing Sheet

Fig. 1a
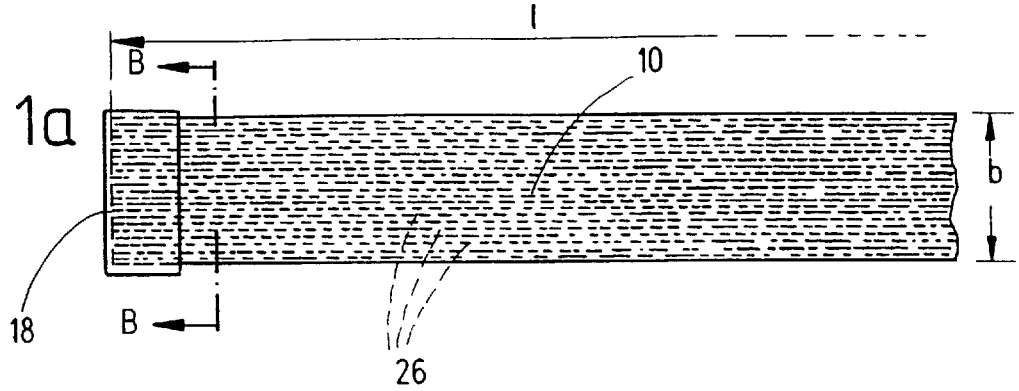
Fig. 1b
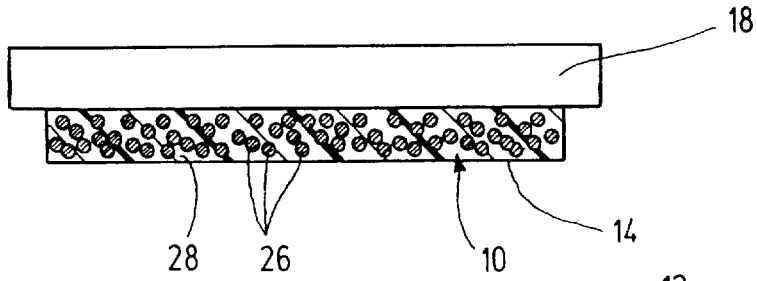
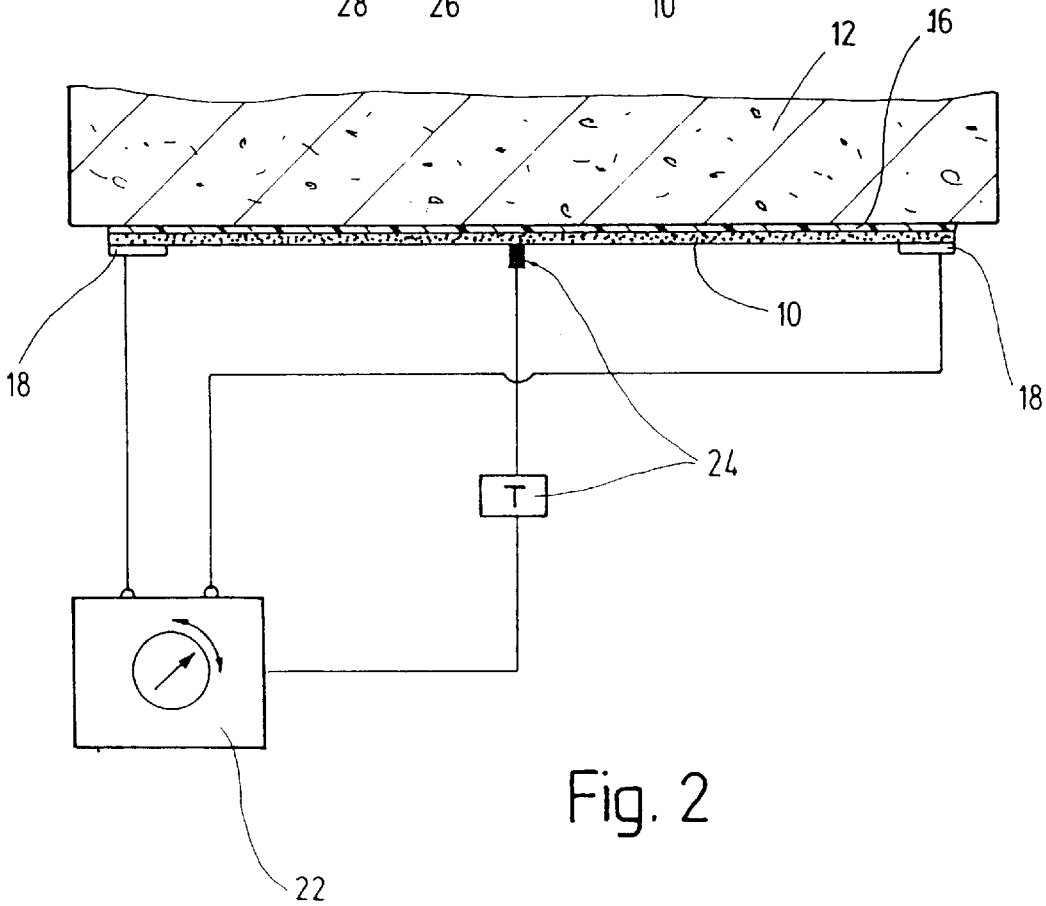
Fig. 2

METHOD FOR FASTENING A FLAT STRIP LAMELLA TO THE SURFACE OF A BUILDING COMPONENT

BACKGROUND OF THE INVENTION

1. Field of the Invention

The invention concerns a process for securing a flat strip lamella to a surface of a building component, the lamella comprising a plurality of carbon fibers extending parallel to each other in the lamella longitudinal direction and embedded in a binder matrix, wherein a face of the flat strip lamella is pressed against a surface of a building to which an adhesive layer of a reaction resin had been applied in a paste-like consistency, and wherein the adhesive layer is hardened to form an adhesive bond or joint.

2. Description of the Related Art

Flat strip lamellas of this type are used for strengthening of load-bearing or load-transmitting building or construction components. They are conventionally adhered to a construction component surface using an adhesive layer of an epoxy resin. In this process, it has often been found to be a disadvantage that the hardening of the adhesive requires a relatively long period of time, during which the construction component being re-enforced or the building structure cannot be subjected to loads.

SUMMARY OF THE INVENTION

Beginning therewith, it is the task of the present invention to improve the process of the above-described type in such a manner that, with a relatively simple means, a significant acceleration of the hardening process can be achieved.

Advantageous embodiments and further developments of the invention can be seen from the dependent claims.

The inventive solution is based on the idea that the adhesive layer, which is comprised of a reaction resin, hardens faster as the temperature of the adhesive is increased. In order to achieve this, it is proposed in accordance with the invention that an electric current is conducted through a part of the carbon fibers, heating the re-enforcing lamella and thereby heating the adhesive layer via the re-enforcing lamella, herein advantages taken of the fact that the carbon fibers extending through the entire length of the flat strip lamella have a certain electrical conductivity, which can be used for an ohmic heating of the flat strip lamella.

According to a preferred embodiment of the invention, the adhesive layer is heated to a temperature of > 40° C. via the re-enforcing lamella. Thereby, the curing or hardening time required for, e.g., an epoxy resin adhesive, which at environmental temperature may require approximately 1–2 days, can be reduced to 1–2 hours. Further, the hardening at higher temperatures results in a higher glass transition point and a better stiffness and bonding effect of the adhesive.

For introduction of the electrical current, one metallic contact plate connected to a source of current is preferably pressed against each of the respective ends of the flat strip lamella. In certain cases it is necessary to reduce the transmission resistance between the contact plate and the lamella surface. For this purpose, prior to the application of the contact plates, the lamella upper surface at the contact point can be roughened up or ground down, exposing of carbon fibers.

In accordance with one preferred embodiment of the invention, the temperature can be measured over time at least one position on the re-enforcing lamella and/or the adhesive layer, and by variation of the current supply the electrical heat yield can be adjusted or regulated in accordance with a predetermined protocol.

In order to obtain reproducible heating times, it is recommended in accordance with the invention to measure the electrical resistance of the flat strip lamella extending between the metallic contact plates prior to the heating process, and to adjust the electrical voltage and/or the current strength at the current source in accordance with a predetermined surface-area dependent power density taking into consideration the measured resistance.

BRIEF DESCRIPTION OF THE DRAWINGS

In the following, the invention will be described in greater detail on the basis of an illustrative embodiment shown in schematic manner in the drawings. There is shown: FIG. 1*a* a top view of a segment of a flat strip-lamella; FIG. 1*b* a section along the section-line B—B of FIG. 1*a* in enlarged representation; FIG. 2 a section through a construction component, onto which a re-enforcing lamella according to FIGS. 1*a* and *b* is adhered, with heating of the adhesive.

DETAILED DESCRIPTION OF THE INVENTION

The flat strip lamella 10 shown in the drawings is designed for supplemental re-enforcing of construction components 12, such as steel re-enforced concrete structures and masonry. They are secured along one surface 14 to the outer surface of the construction component with the help of an adhesive 16 preferably comprised of epoxy resin.

The flat strip lamella 10 is a composite structure comprised of a plurality of flexible or flaccid re-enforcing carbon fibers 26 extending parallel to each other and a binder matrix 28 of epoxy resin which bonds the re-enforcing fibers to prevent sliding with respect to each other. The binder matrix 28 ensures that the flat strip lamella 10 is stiff-elastic.

For securing the flat strip lamella 10 to the construction component 12, first a reaction adhesive in pasty form, preferably an epoxy resin, is applied to the outer surface of the construction component 12. Then, the pre-measured flat strip lamella 10 is pressed against the adhesive layer 16 onto the construction component surface. In order to accelerate the curing or hardening time of the adhesive, the flat strip lamella 10 is heated with the aid of electric current. For this purpose, metal plates 18 are pressed against the lamella outer surface at the ends of the flat strip lamella, so that an electrical contact results. In order to minimize the contact resistance, the lamella ends can be prepared by roughening or abrading, resulting in exposure of the carbon fibers 26. The metal plates 18 are connected to a source of current 22 via a conductor 20, so than an electrical current can be conducted through the carbon fibers 26 contacting the metal plates 18. The carbon fibers 26 form a resistance heater for heating the flat strip lamella. In order that the heat yield can be adjusted to correspond to the desired heating time, the voltage and the current strength of the current source can be varied. Since the length of the flat strip lamella to be adhered and the effective conductive cross-section of the carbon fibers to be coupled to the current flow can vary substantially from case to case, it is of advantage, when first with the aid of a resistance measuring device the ohmic resistance R of the lamella to be applied to the construction component is measured and from the measured value the voltage U to be applied or the desired current strength I can be determined as follows:

$$U=\sqrt{q\cdot l\cdot b\cdot R} \quad (1)$$

$$I=\sqrt{q\cdot l\cdot b/R} \quad (2)$$

wherein R represents the measured resistance, 1 and b represent the length and the breadth of the flat strip lamella to be applied to the construction component, and q represents an empirically to be determined surface area related thermal yield density. As a rule, the thermal yield density q is selected in a range of from 1 to 20 W/cm$^2$.

In principal it is possible also to use a dimmer, which can be controlled for example according to the phase gate or chopping process, for the adjustment of the heat production.

For monitoring the temperature, a temperature detector 24 can be coupled to the flat strip lamella, of which the output signal can be used for controlling or regulating the thermal yield.

In summary, the following is to be concluded: The invention relates to a method for fastening a flat strip lamella 10 to the surface of a building component 12. According to the inventive method, the face 14 of the flat strip lamella 10 is pressed against the surface of the building using an adhesive coating 16 consisting of a reaction resin applied in a paste-like consistency 16 and hardened to form an adhesive joint. The flat strip lamella 10 comprises a plurality of carbon fibers which are embedded in a binder matrix 28 and placed parallel to each other in a longitudinal direction. In order to increase the speed at which the adhesive coating hardens, the invention provides that an electrical current flows through least one part of the carbon fibers 26, heating the flat strip lamella 10 which in turn heats the adhesive coating 16.

What is claimed is:

1. A process for securing a flat strip lamella to a construction component surface, the flat strip lamella having a first end and a second end and comprising a plurality of carbon fibers extending parallel to each other in a longitudinal direction in a binder matrix, said process comprising:

applying an adhesive layer comprising a reaction resin in a pasty consistency directly to the construction component surface;

pressing the flat strip lamella against the adhesive layer;

roughening or abrading the flat strip lamella outer surface to expose carbon fibers at contact areas located at said first and second ends of the flat strip lamella;

pressing a metallic contact plate against each of the first and second ends of the flat strip lamella, respectively;

connecting the contact plates to a source of electrical current;

conducting electrical current through at least a portion of the carbon fibers such that the flat strip lamella is heated and the adhesive layer is heated via the flat strip lamella, thereby accelerating hardening of the adhesive layer to produce an adhesive bond between said flat strip lamella and said construction component surface.

2. A process according to claim 1, wherein the adhesive layer is heated via the flat strip lamella to an average temperature of greater than 40° C.

3. A process according to claim 1, wherein the temperature is measured over time at least one part of the flat strip lamella and/or the adhesive layer (16) and adjusted or regulated by variation of the electrical heating power produced by the applied current.

4. A process according to claim 1, wherein prior to the heating process the electrical resistance (R) in the flat strip lamella extending between the metallic contact plates is measured, and the electrical voltage and/or the current strength (amperage) is adjusted to a defined value according to the value of a predetermined surface area dependent heating power under consideration of the measured resistance.

5. A process according to clam 4, wherein the current source is adjusted to an electrical voltage according to the relationship, $$U=\sqrt{q\cdot l\cdot b\cdot R}$$

wherein l and b represent the length and the breadth of the flat strip lamella being measured, R represents the measured electrical resistance and q represents a heating power to be selected according to a desired heating time.

6. A process according to claim 4, wherein the current source is adjusted to an electrical current value according to the equation, $$I=\sqrt{q\cdot l\cdot b/R}$$

wherein l and b represent the length and the breadth of the flat strip lamella being measured, R represents the measured electrical resistance and q represents a heating power to be selected according to a desired heating time.

7. A process according to claim 5, wherein for the magnitude q a value of 1–20 W/cm$^2$ is selected.

8. A process according to claim 6, wherein for the magnitude q a value of 1–20 W/cm$^2$ is selected.

9. A process for securing a flat strip lamella to a construction component surface, the flat strip lamella having a first end and a second end and comprising a plurality of carbon fibers extending parallel to each other in a longitudinal direction in a binder matrix, said process comprising:

applying an adhesive layer directly to the construction component surface, the adhesive layer comprises a reaction resin in a pasty consistency;

pressing the flat strip lamella against the adhesive layer; and hardening the adhesive layer to produce an adhesive bond;

wherein an electrical current is conducted through at least a portion of the carbon fibers such that the adhesive layer is heated via the flat strip lamella, wherein a metallic contact plate is pressed against each of the first and second ends of the flat strip lamella; and wherein prior to the heating process the electrical resistance (R) in the flat strip lamella extending between the metallic contact plates is measured, and the electrical voltage and/or the current strength (amperage) is adjusted to a defined value according to the value of a predetermined surface area dependent heating power under consideration of the measured resistance.

* * * * *

UNITED STATES PATENT AND TRADEMARK OFFICE

CERTIFICATE OF CORRECTION

PATENT NO. : 6,605,168 B1 
DATED : August 12, 2003
INVENTOR(S) : Alexander Bleibler, Ernesto Schumperli and Werner Steiner It is certified that error appears in the above-identified patent and that said Letters Patent is hereby corrected as shown below:

Title page,
Item [22], PCT Filed:, the date should read -- July 15, 1998 --

Signed and Sealed this

First Day of June, 2004

JON W. DUDAS
*Acting Director of the United States Patent and Trademark Office*